US007360575B2

(12) United States Patent
Weiss

(10) Patent No.: US 7,360,575 B2
(45) Date of Patent: Apr. 22, 2008

(54) ROLLER BLIND SYSTEM

(76) Inventor: Albert Weiss, Schillerstrasse 9, D-74747, Ravenstein (DE)

( * ) Notice: Subject to any disclaimer, the term of this patent is extended or adjusted under 35 U.S.C. 154(b) by 1198 days.

(21) Appl. No.: 10/159,762

(22) Filed: May 30, 2002

(65) Prior Publication Data

US 2003/0136527 A1 Jul. 24, 2003

(30) Foreign Application Priority Data

Jan. 18, 2002 (EP) ..... 02001326

(51) Int. Cl.
*A47G 5/02* (2006.01)

(52) U.S. Cl. ..... 160/273.1; 160/264

(58) Field of Classification Search ..... 160/273.1, 160/271, 270, 269, 264, DIG. 7
See application file for complete search history.

(56) References Cited

U.S. PATENT DOCUMENTS

| | | | | |
|---|---|---|---|---|
| 669,967 | A | 3/1901 | Solomon | |
| 881,507 | A * | 3/1908 | Wallen | 160/273.1 |
| 984,313 | A | 2/1911 | Stiles | |
| 1,423,524 | A | 7/1922 | Hill et al. | |
| 1,749,734 | A | 3/1930 | Kelly | |
| 1,992,728 | A | 2/1935 | Wattman | |
| 2,132,986 | A * | 10/1938 | Julien | 160/273.1 X |
| 2,501,454 | A * | 3/1950 | Schueren | 160/273.1 |
| 2,689,004 | A * | 9/1954 | Van Der Horst | 160/273.1 X |
| 3,236,290 | A * | 2/1966 | Lueder | 160/DIG. 7 X |
| 3,292,685 | A | 12/1966 | Clark | |
| 3,470,928 | A | 10/1969 | Schwartz | |
| 3,656,323 | A | 4/1972 | Brown | |
| 3,750,740 | A | 8/1973 | Newman | |
| 3,945,096 | A | 3/1976 | Miranker | |
| 4,033,151 | A | 7/1977 | Jansen | |
| 4,335,773 | A * | 6/1982 | Masi | 160/23.1 |
| 4,531,562 | A * | 7/1985 | Swanson | 160/DIG. 7 X |
| 4,815,515 | A * | 3/1989 | Lee | 160/23.1 |
| 4,934,435 | A | 6/1990 | Regev | |
| 5,067,546 | A | 11/1991 | Jeuffray et al. | |
| 5,099,905 | A | 3/1992 | Rigter | |
| 5,287,908 | A | 2/1994 | Hoffman et al. | |
| 5,353,858 | A | 10/1994 | Hartmann | |
| 5,651,406 | A * | 7/1997 | Schaap | 160/273.1 |
| 5,791,392 | A | 8/1998 | Lopez | |

(Continued)

FOREIGN PATENT DOCUMENTS

| | | |
|---|---|---|
| AT | 343334 | 5/1978 |

(Continued)

OTHER PUBLICATIONS

Search Report, EP 02 00 1326, 2 pages.

(Continued)

*Primary Examiner*—David Purol
(74) *Attorney, Agent, or Firm*—Dority & Manning, P.A.

(57) ABSTRACT

A roller blind for covering openings to refrigeration units, windows, and sliding roofs for vehicles is provided in which the roller blind web defines a tubular pocket along respective longitudinal sides of the web. Opposing guide members are positioned on opposite sides of the roller blind web and retain therein the respective tubular pockets. Optionally, the tubular pockets may extend in both the warp and weft direction and additional interior pockets may be provided along the web.

3 Claims, 3 Drawing Sheets

U.S. PATENT DOCUMENTS

| | | | | |
|---|---|---|---|---|
| 6,212,913 | B1 | 4/2001 | Weiss | |
| 6,286,579 | B1 * | 9/2001 | Gottschalk | 160/264 |
| 6,474,395 | B2 | 11/2002 | Weiss | |

FOREIGN PATENT DOCUMENTS

| | | | |
|---|---|---|---|
| CH | 455231 | | 4/1968 |
| DE | 264173 | | 9/1913 |
| DE | 1866000 | | 1/1963 |
| DE | 2601899 | A1 | 9/1976 |
| DE | 3525515 | A1 | 1/1987 |
| DE | 3529418 | C1 | 4/1987 |
| DE | 3929284 | A1 | 4/1991 |
| DE | 4419410 | A1 | 12/1995 |
| DE | 19609082 | A1 | 10/1996 |
| DE | 19836447 | A1 | 9/1999 |
| DE | 29922593 | U1 | 4/2000 |
| EP | 0033478 | | 8/1981 |
| EP | 0194480 | | 9/1986 |
| EP | 0389104 | | 9/1990 |
| EP | 0291426 | A1 | 11/1998 |
| FR | 2516948 | | 5/1983 |
| GB | 1454375 | | 11/1976 |
| JP | 10212878 | A | 11/1998 |
| JP | 10306669 | A | 11/1998 |
| NL | 9001495 | | 1/1992 |

OTHER PUBLICATIONS

Search Report, 100 54 852.0, 2 pages.

* cited by examiner

ROLLER BLIND SYSTEM

RELATED APPLICATIONS

This application claims the benefit of German application serial number 100 54 852.0 filed on Nov. 6, 2000, and European Community application serial number 02 011 326.4 filed Jan. 18, 2002.

FIELD OF THE INVENTION

The present invention relates to a roller blind system for covering openings such as windows, refrigerator openings, sliding roof vehicles, and similar openings.

BACKGROUND OF THE INVENTION

In order to cover openings, e.g., in refrigerators, windows, sliding roofs for vehicles and the like, it is known that a roller blind, or similar web structure, can be guided within laterally parallel guides of the cover openings and which further provides a connection with the wall parts limiting the opening. A cover guide rail is usually provided for this in which the roller blind rod slides and guides the roller blind web following the roller blind rod. In the case of Venetian blinds, in which the roller blind web consists of individual, rigid strips, the closure of a window opening is on the whole satisfactory. However, these roller blind webs are massive and therefore require a corresponding spatial and financial cost. This type of roller blinds is not suitable for sliding roofs of vehicles nor useful as roller blinds for darkening rooms for presentations of films or photographs.

In order to darken rooms for the presentation of films or photographs, roller blind webs are used that consist of a thin, flexible material. The roller blind webs are lowered vertically in front of the window openings. In order to avoid the incidence of light, a broad cover strip is set on the edge in front of the window opening on which strip the roller blind web rests. This cover strip can also be designed to be double-sided, so that the roller blind web runs in a guide. This type of guidance requires a relatively large amount of space and necessitates that the flexible roller blind web hang down substantially vertically. Also, a tight guidance of the roller blind web is not assured and the incidence of light can not be completely avoided due to the required width of the guide slot.

With respect to closures for a refrigeration unit, it is important that the refrigerator be tightly closed to avoid an undesired exchange of air and therewith a loss of heat while at the same time permitting ready access to goods stored in a refrigerator. In locations and operating environments commonly found in schools, administrative offices and cafeterias, self-service refrigerators are used during breaks and at meals. At other times, the refrigerators should be closed to secure against product theft and to conserve energy.

In the case of vehicles, a stable guidance of the roller blind edges that resists wind pressure and similar influences is important.

Lateral guides for roller blinds or protective curtains are known that comprise a hollow seam or border on the roller blind web and which extend along an edge running vertically to the roll-down axis. The seam is held laterally in the rolled-down state by a rod element by which the hollow seam is pulled when the roller blind or protective curtain is rolled down. The rolled-down curtain is held substantially along the entire hollow seam on the rod element as seen in references DE 2 99 225 93 U1 and DE 19 609 082. The roller blind systems described in the cited references do achieve an obligatory and stable connection of the roller blind to the wall limiting the opening; however, the hollow seam for guiding the roller blind has a disadvantage in that the hollow-seam edge becomes bulky during rolling up and therefore increases the diameter of that portion of the blind relative to the rest of the roller blind web. As a result, the winding up not only requires a significant amount of space but also results in a non-uniform winding up and a subsequent distortion of the roller blind web. Moreover, the manufacture of such hollow seams requires additional manufacturing effort which renders the roller blind device more expensive.

The present invention therefore has the problem of eliminating these disadvantages and creating a roller blind system that assures a stable and obligatory connection of the roller blind to the wall limiting the opening to be closed but is yet simple and thus economical to manufacture. This problem is solved by a roller blind system for covering openings in a refrigerator, window, sliding vehicle roof, and similar openings in which a roller blind web comprises tubular pockets on its longitudinal sides, the pockets being engaged by a parallel guide arranged on opposite sides of the opening, the tubular pockets extending in a longitudinal direction along the roller blind web.

In one embodiment of the invention, the parallel guide further defines a hollow profile which is closed on one end opposite a reel of the roller blind by a cap, the cap further securing a terminus of the guide rod.

In addition, double layers of materials and seam junctures are avoided, so that the roller blind web exhibits a uniform thickness over the entire width including the edge area, as a result of which irregularities during rolling up and deformations are avoided.

If tubular pockets are worked into the material web over the width at certain intervals, roller blind webs with different widths can be manufactured in accordance with the grid of these tubing pockets without having to set a certain roller blind width during the manufacture already. This achieves great flexibility of adaptation to different, required roller blind widths and reduces inventory storage needs. The lateral guidance is established in a simple manner by a rod engaging into the tubing pocket so that voluminous boxes for a lateral guidance of the border edge of the roller blind are not necessary. As a result of the obligatory guidance a short engagement of the border edge of the roller blind into the lateral guide is sufficient. This is especially advantageous in vehicle construction.

Tolerances can be readily compensated and the roller blind web held under tension by the transverse mobility of the guide rod and by a fastening of the hollow profile that is elastic in the direction of movement of the roller blind.

Further details of the invention are described below with reference made to the drawings.

DETAILED DESCRIPTION

Figure 1:
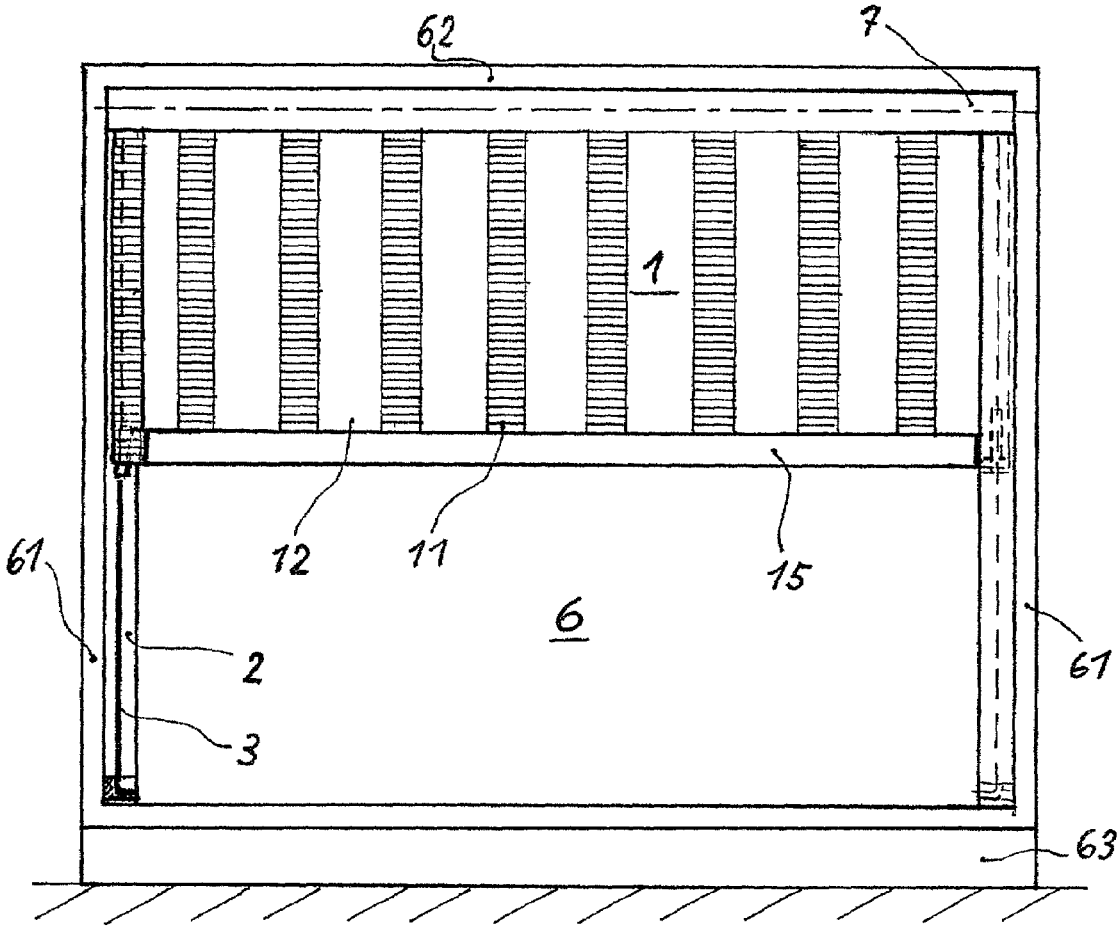
FIG. 1 shows the roller blind system of the invention in a front view.

FIG. 1 shows a front view of a refrigerator 6 with lateral walls 61, top 62 and base 63. A roller blind device consisting of roller blind web 1 with closure strip 15 and parallel guides 2 and roller blind reel 7 is provided for covering the opening formed by lateral walls 61 and top 62.

Figure 4:
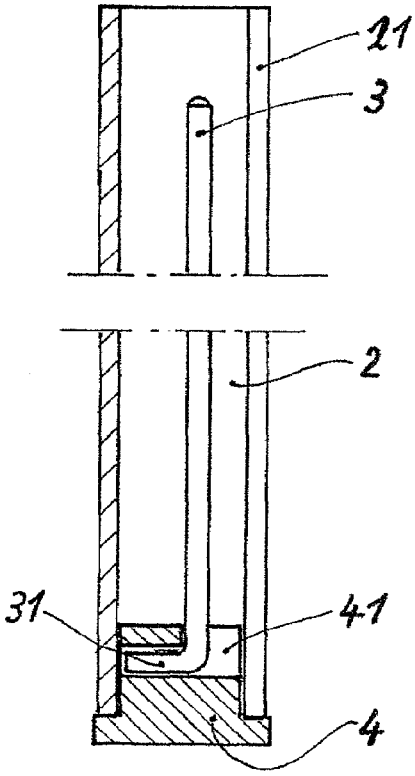
FIG. 4 shows left-side roller blind guide in section.
Figure 5:
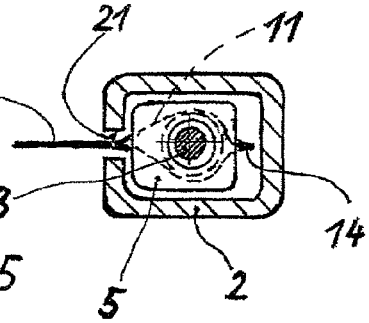
FIG. 5 shows a cross section of FIG. 6.

As best seen in reference to FIGS. 4 and 5, the parallel guides are designed as box-shaped hollow profile 2 with longitudinal slot 21 through which roller blind web 1 can pass. Guide rod 3 is arranged inside hollow profile 2, the diameter of rod 3 being greater than the width of longitudinal slot 21. The guide rod 3 engages tubular pocket 11 of roller blind web 1 that is widened as a consequence so that roller blind web 1 is held fast with its border edge 14 inside hollow profile 2. Roller blind web 1 with tubing pocket 11 widened by guide rod 3 is supported thereby on the inside of hollow profile 2 and can not be withdrawn through this slot 21. A forced guidance of roller blind 1 is produced in this manner. Guide rod 3 is anchored by its bent foot 31 in recess 41 of closure cap 4 on the lower end of hollow profile 2. As is apparent from FIG. 4, recess 41 is open at the top on the side facing slot 21 so that guide rod 3 can slide horizontally by its foot 31 in this recess 41. In this manner tolerances in the width of roller blind web 1 can be compensated so that roller blind web 1 is always supported by widened tubular pockets 11 on both sides of longitudinal slot 21 on hollow profile 2 and is uniformly tensioned.

Figure 3:
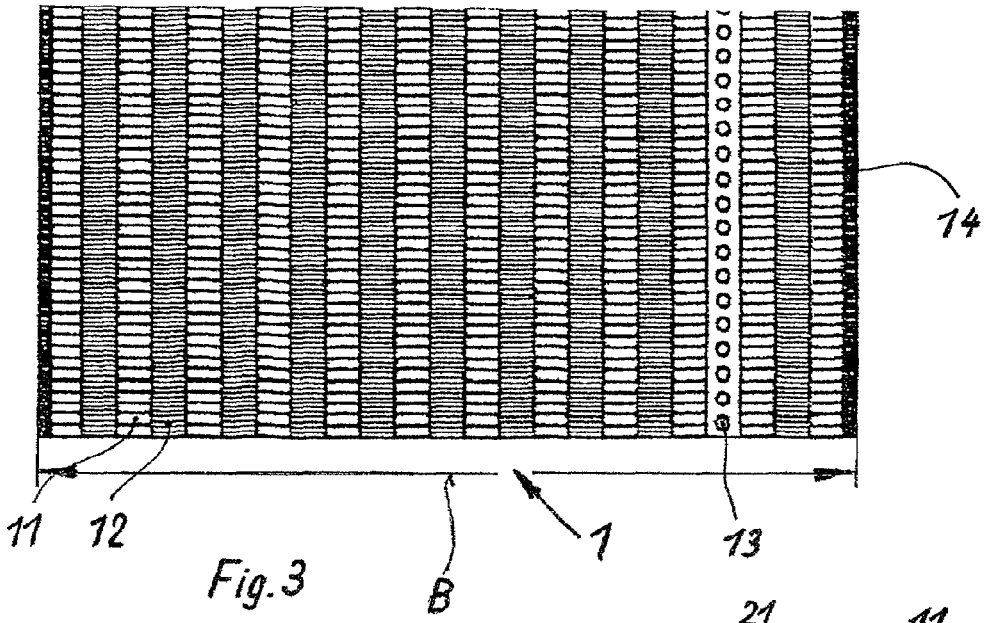
FIG. 3 shows the roller blind in section.

Roller blind web 1 preferably consists of a woven fabric into which tubular pockets 11 have been woven in, e.g., in the warp direction. As is apparent from FIG. 3, the tubular pockets 11 can be worked in at certain intervals in the weft direction. These tubular pockets 11 are arranged on the edge of roller blind web 1 for receiving guide rod 3, within the tubular pockets 11 and thus guides roller blind web 1 in a directed manner during its up and down movement. The arrangement of the tubular pockets 11 distributed in the weft direction over the width of roller blind web 1 has the advantage that the material for roller blind web 1 can be manufactured with a uniform work width and that roller blind webs 1 can be cut out of the same material in different widths B. Cut edges 14 are then worked for strengthening, which can take place, e.g., by welding the synthetic material so that a fraying of these edges is prevented. The edges can also be strengthened by adhering, e.g., during a bonding or coating process.

Figure 7:
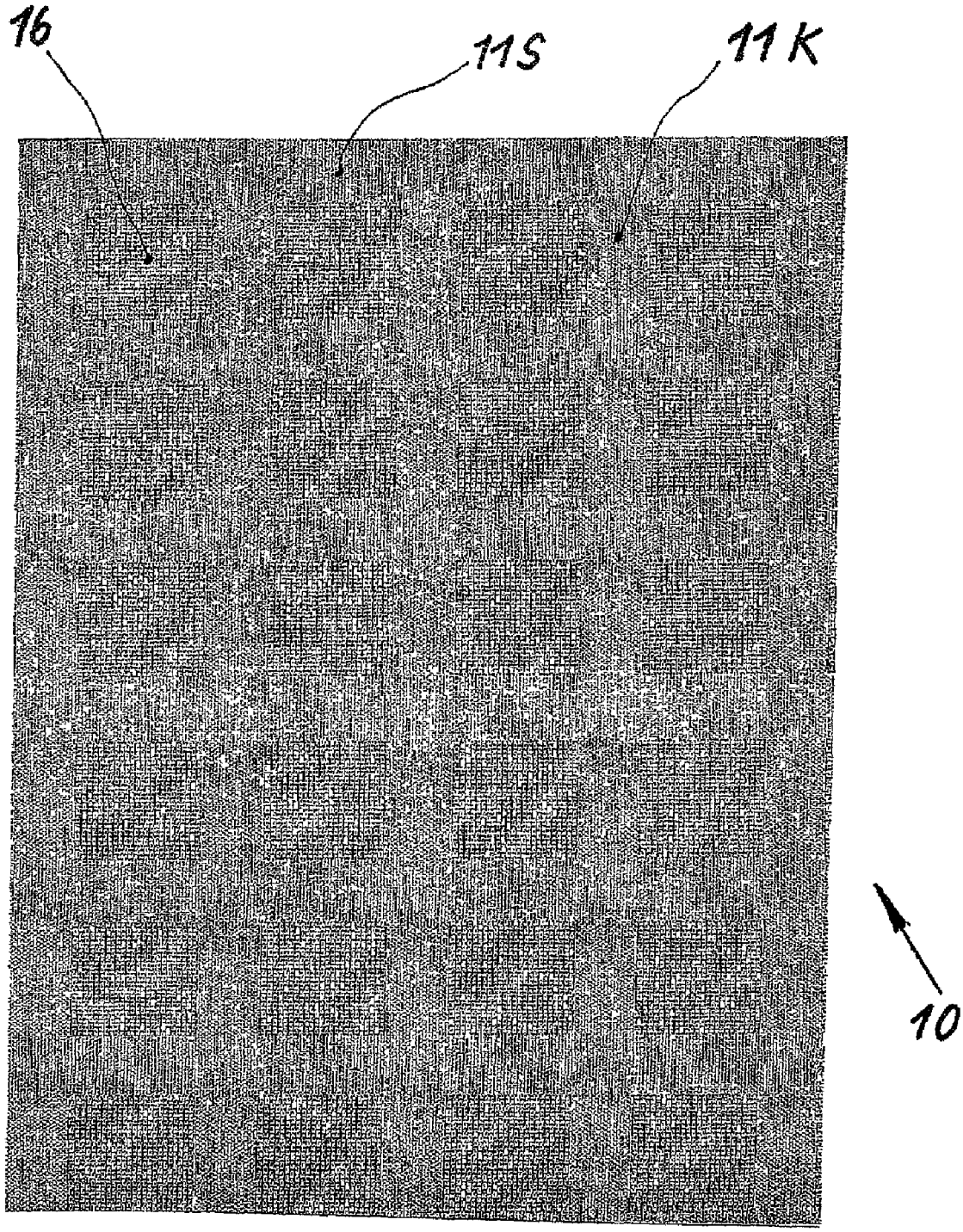
FIG. 7 shows a roller blind web with tubing pockets in the warp direction and the weft direction.

FIG. 7 shows an original illustration of a section of a roller blind web 10 comprising tubular pockets 11 in the weft direction (11S) and also in the warp direction (11K). Material fields 16 consisting of a single-layer woven fabric are produced between the cross of tubular pockets 11. These material fields 16 are manufactured with a coarser weave so that a certain transparency prevails in these material fields, as explained below. Such a material web with tubular pockets 11S and 11K can be used both in its width and also in its length as a roller blind web since pockets 11S as well as pockets 11K can receive guide rods 3. Depending on whether pockets 11S or 11K are located in the transversal direction to the material web, they can then serve to receive the roller blind rod or also stiffening rods. In such a design roller blind webs can be manufactured very flexibly for very different uses and dimensions.

The manufacture of roller blind web 1 takes place in that at first a woven fabric is manufactured in which tubular pockets 11 are woven in the longitudinal direction (warp direction) of roller blind web 1. As is apparent from FIG. 7, tubular pockets 11S can be woven in at the same time in the transversal or weft direction also, so that a checked structure is produced. The manufacture of such pocket fabrics is basically known and therefore does not need to be described in detail here. These fabrics can be readily manufactured with the customary chain or dobby looms. However, a jacquard power loom is required for irregular contours.

As already mentioned above, it is advantageous if the full work width of the loom is utilized. Pockets 11 are worked in, i.e., woven, over the width of the web at such an interval that, depending on the desired roller blind width, these pockets 11 laterally limit different roller blind web widths B so that different roller blind web widths B can be cut out of the original web. The fabric is compressed in the area of pockets 11 on the two fabric planes by the use of additional threads, e.g., in the warp. Material strips 12 between pockets 11 are advantageously woven in an open structure. However, care must be taken that the fabric has the same thickness in the area of pockets 11 as well as between pockets 11 in order that no beads are produced when rolling up.

After the woven fabric is completed it is washed, fixed and finished in such a manner that a closed, covering coating is applied in the area of the closely woven pockets on both sides. Care must be taken that the finishing mass or coating mass does not adhere the two fabric webs in the area of pockets 11 to one another. Aside from the fact that it is necessary for this to adjust the viscosity of the coating mass in such a manner that it does not penetrate textile roller blind web 1, it is necessary to take steps to assure that the roller blind web 1 to be coated is compact enough, at least in the area of pockets 11. This can take place in various ways. It has proven to be beneficial if roller blind web 1 is hot-ironed (at approximately 210° C.) at least in the area of pockets 11. This compresses the threads in such a manner that no coating mass penetrates. The use of texturized thread material has also proved to be especially advantageous. Both measures can also be used in a combined manner for reliability as referenced in the inventor's prior patent application set forth in DE 19836447.4.

The air permeability remains largely preserved in the case of material strips 12 between pockets 11 since the finishing mass or coating mass does not completely close the coarse fabric structure. The latter can be achieved either by a differing density of the woven fabric structure in the area of the pockets and strips or by adjusting the viscosity of the finishing or coating mass. The air permeability in intermediate strips 12 brings about a controlled convection, e.g. in roller blind devices for refrigerators, in the area of roller blind web 1 and thus prevents condensation water and perspiration water.

This controlled convection can also be achieved in the following manner: After the washing and fixing the woven fabric is coated in a covering fashion on both sides by a bonding with foils or also by a wiper coating. A closed, air-tight woven fabric is produced in this manner. Care must also be taken during the coating that the interior surfaces of pockets 11 do not adhere to each other. Appropriate adjustments to the pressure, temperature, and/or the viscosity of the coating mass may be made in addition to the previously mentioned techniques. After the coating, perforations 13 are stamped out in the area of strips 12 between pockets 11 in order to re-establish a certain, controlled air permeability of the material, that is necessary to achieve a convection flow in the area of roller blind web 1 to prevent condensation water and perspiration water.

In order to further increase the effectiveness of energy savings and thermal insulation the woven fabric web can also be vapor-deposited and sealed after the washing and fixing with aluminum, during which a previously vapor-deposited foil can also be bonded on in the latter process.

The desired roller blind web 1 is now manufactured by cutting the woven fabric web to size. The outermost edge of pockets 11 suitable for the desired width are subsequently used. The cuts to the fabric web are made in such a manner that a narrow border edge 14 remains outside of the outer edge of pockets 11. This border edge 14 is additionally welded in order to prevent fraying. Roller blind web 1 is then fastened by its one end to roller blind reel 7. On the other end the guide rods 3 are introduced into the two respective edge pockets 11 to the right and the left on the material blank.

Figure 6:
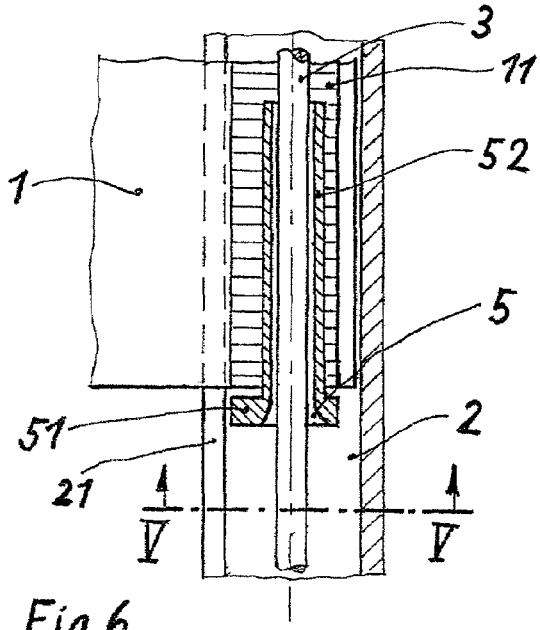
FIG. 6 shows a right-side roller blind guide in section.

In order to facilitate the introduction of guide rods 3 into pockets 11, funnel-shaped guide pieces 5 can also be inserted into the pockets 11, the guide pieces 5 surround guide rod 3 as best seen in reference to FIGS. 5 and 6. Guide 5 defines a sleeve 52 and which is supported by a collar 51 on the inner wall of hollow profile 2. In this manner not only an easy introduction of guide rods 3 into pockets 11 is achieved but also at the same time an easy, unhindered sliding of roller blind web 1 in parallel guides 2 is achieved. Closure strip 15 (FIG. 1) is attached to the free end of roller blind web 1 facing away from reel 7 in such a manner that the material edge is enclosed and guide pieces 5 are held in the exact position. To this end, closure strip 15 can be designed as a clamping profile or also as a two-part profile that is screwed together, adhered or welded.

Figure 2:
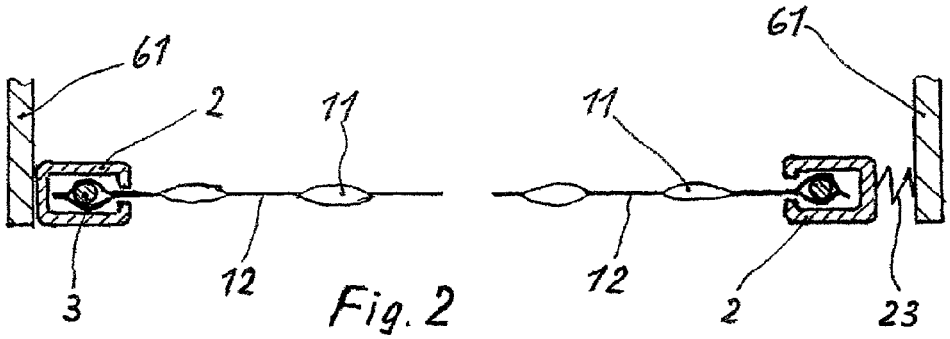
FIG. 2 shows the roller blind system of FIG. 1 in a top view in cross section.

The roller blind system is preferably installed as a structural unit consisting of shaft 7 for winding up the roller blind web with a winding-up or reel mechanism, and of roller blind web 1 itself with closure strip 15 in a housing fixed to top 62 of refrigerator 6. Parallel guides 2 are fastened to side walls 61 and can be fastened with traction springs 23 to refrigerator wall 61, as is apparent from FIG. 2. In this manner parallel guide 2 can exert an appropriate force for tensioning roller blind web 1 in the transversal direction.

As addressed above, the guidance of roller blind web 1 takes place on the edges by means of guide rods 3 that are arranged in hollow profiles 2 and engage in pockets 11 worked in at the edge of roller blind web 1. Roller blind web 1 is thus pushed with pocket 11 over the guide rod 3 when the roller blind web 1 is retracted or extended. Guide rod 3 is fixed in hollow profile 2, profile 2 further comprising a longitudinal slot 21 through which roller blind web 1 extends. Respective pockets 11 and rods 3 are arranged inside hollow profile 2. The slot 21 is only wide enough that roller blind web 1 can pass through it. Pocket 11 which is engaged by rod 3 is retained by the hollow profile and by collar 51 of guide piece 5. Whereas guide rod 3 is stationary, roller blind web 1 can be pushed up and down and is drawn off from guide rod 3 during rolling up. However, it is advantageous if a part of roller blind web 1 remains introduced in pocket 11 with grip strip 15.

An absolutely reliable, lateral forced guidance is achieved in this manner. The opening of refrigerator 6 can be completely closed. The slot-free closure at lateral walls 61 of refrigerator 6 achieves an optimal savings of energy and prevents access when the roller blind is closed.

This roller blind system makes extremely small structural dimensions possible since no bead is produced when the material is wound up onto roller blind reel 7. This is especially important in vehicle construction. Instead of a resilient fastening of parallel guide 2, roller blind web 1 can also be tensioned in the weft direction by working in elastic threads.

The roller blind system and the roller blind web are described above as a woven fabric. However, the roller blind web can also be manufactured as a warp knitted fabric with the appropriate binding techniques.

The invention claimed is:

1. A roller blind for alternately covering and uncovering an area, the roller blind comprising a woven or knitted web, the, woven or knitted web defining a single layer of fabric having a first plurality of tubular pockets woven or knitted into the fabric, each of said tubular pockets extending in a warp direction, each of said tubular pockets adapted for receiving a guide member for guiding movement of said web when alternately covering and uncovering the area, wherein said woven or knitted web further defines a second plurality of pockets woven or knitted into the web and extending in the weft direction of the web.

2. A fabric roller blind web for alternately covering and uncovering an area, the roller blind web defining a single layer of fabric and comprising a series of tubular pockets defined within the fabric web by having been knitted or weaved therein, the tubular pockets extending in a warp direction and uniformly spaced across the width of the fabric web, at least two of the pockets being adapted for receiving a guide member for guiding movement of the web when alternately covering and uncovering the area, wherein additional tubular pockets are knitted or weaved into the fabric and extend in a weft direction.

3. A fabric roller blind web for alternately covering and uncovering an area, the roller blind web defining a single layer of fabric and comprising a series of tubular pockets defined within the fabric web by having been knitted or weaved therein, the tubular pockets extending in a warp direction and uniformly spaced across the width of the fabric web, at least two of the pockets being adapted for receiving a guide member for guiding movement of the web when alternately covering and uncovering the area, wherein a thickness of said tubular pockets is substantially the same as a thickness of the fabric web defined between the tubular pockets.

* * * * *